United States Patent [19]

Holland, III

[11] Patent Number: 4,899,470

[45] Date of Patent: Feb. 13, 1990

[54] ATHLETIC SHOE

[76] Inventor: Philo K. Holland, III, 924 E. 200 S. #4, Salt Lake City, Utah 84102

[21] Appl. No.: 47,731

[22] Filed: May 8, 1987

[51] Int. Cl.[4] ..... A43B 5/02

[52] U.S. Cl. ..... 36/133; 36/128

[58] Field of Search ..... 36/128, 133, 117, 25 R, 36/114, 127; 273/55 B; D2/311, 309

[56] References Cited

U.S. PATENT DOCUMENTS

| | | | |
|---|---|---|---|
| 3,411,224 | 11/1968 | Wagner | 36/117 |
| 3,490,155 | 1/1970 | Herunter | 36/117 X |
| 4,204,346 | 5/1980 | Fugere | 36/133 X |
| 4,389,798 | 6/1983 | Tilles | 36/129 |
| 4,712,317 | 12/1987 | Sowell | 36/133 |
| 4,748,753 | 6/1988 | Ju | 36/127 |

FOREIGN PATENT DOCUMENTS

| | | | |
|---|---|---|---|
| 2743666 | 3/1978 | Fed. Rep. of Germany | 36/133 |
| 2652055 | 5/1978 | Fed. Rep. of Germany | 36/133 |
| 3314274 | 10/1983 | Fed. Rep. of Germany | 36/128 |
| 206351 | 5/1981 | United Kingdom | 36/133 |

*Primary Examiner*—James Kee Chi

*Attorney, Agent, or Firm*—Lyon & Lyon

[57] ABSTRACT

An athletic shoe adapted for controlling an object with the foot includes multiple planar object control surfaces and a vertically enhanced sole to provide maximum control surface area. The interior portion of the shoe is conformed to the wearer's foot to provide maximum foot dexterity and comfort.

7 Claims, 2 Drawing Sheets

ATHLETIC SHOE

BACKGROUND OF THE INVENTION

The field of the present invention is athletic shoe designs.

Generally, athletic shoes are shaped in conformance with the human foot and the exterior surfaces thereof tend to be curved. Curved exterior surfaces, however, tend to reduce the efficiency of the shoe in sports where the shoe is used for intricate control of an object, such as a ball or a bag. For instance, in the sport of footbag, foot control is very important. A footbag is a generally spherically-shaped, soft bag approximately 2 inches in diameter which is filled with hundreds of small elements, such as barley seeds or plastic pellets. A participant in the sport is allowed to propel or control the footbag with any part of the lower body and thus the most frequently used propelling agent is the participant's foot. Athletic shoes which have generally curved exterior surfaces tend to cause the footbag to be propelled in erratic directions, thus reducing the ability of a participant to control it. Moreover, being generally curved such athletic shoes generally possess no well-defined impact surfaces. The same drawback exists in the sport of soccer.

Particularly problematic is the instep portion of the shoe which typically comprises a concave compound surface. Although object control can be improved where a convex surface is present (as in the toe area) by visually approximating the anticipated rebound path of an approaching object, such visualization is difficult where a concave surface such as the instep is involved. Moreover, because the instep curves beneath the top of the shoe, the surface thereof often cannot be seen by the wearer unless the foot is positioned at an extreme angle. Accordingly, in sports where an important factor is the ability to control an object with the exterior surfaces of an athletic shoe, including the instep, conventional athletic shoe designs may not be suitable. Even specially-adapted athletic shoe designs have limited effectiveness. For example, U.S. Pat. Nos. 1,221,985, 2,107,667, 4,123,856 and 4,149,325 and U.S. Design Pat. No. 251,757 disclose specially adapted athletic shoe designs for kicking. Each design, however, employs curved exterior surfaces in accordance with conventional shoe design.

SUMMARY OF THE INVENTION

The present invention is directed to an athletic shoe with dimensionally enhanced, visually defined object control surfaces. To this end, the typically curved exterior portions of the sole and upper are eliminated and a vertically enhanced sole is provided. Foot dexterity is retained by providing inner shoe surfaces which conform to the wearer's foot. Other and further advantages will appear hereinafter.

DETAILED DESCRIPTION OF THE PREFERRED EMBODIMENTS

Figure 1:
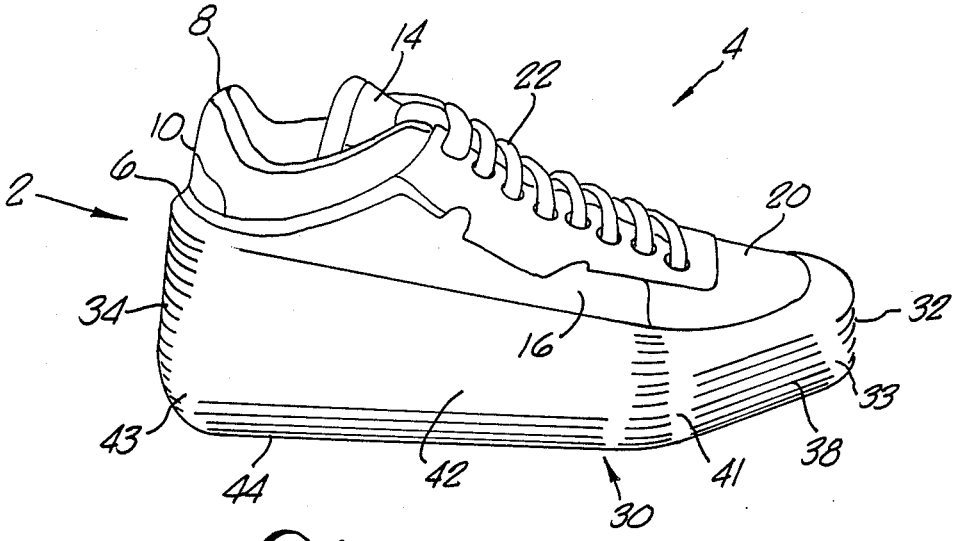
FIG. 1 is a view in side elevation of the outer portion of the shoe.
Figure 2:
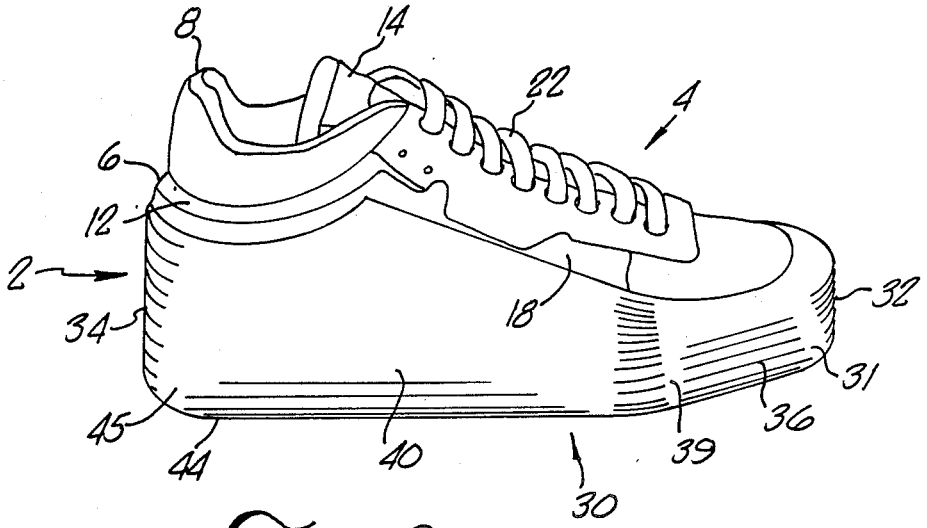
FIG. 2 is a view in side elevation of the inner portion of the shoe.

As shown in FIGS. 1 and 2, an athletic shoe 2 includes an upper 4 that includes a heel 6, a heel tab 8, an outside side quarter 10, an instep side quarter 12, a tongue 14, an outside vamp 16, an instep vamp 18, a toe cap 20, and laces 22 providing fastening means.

Figure 3:
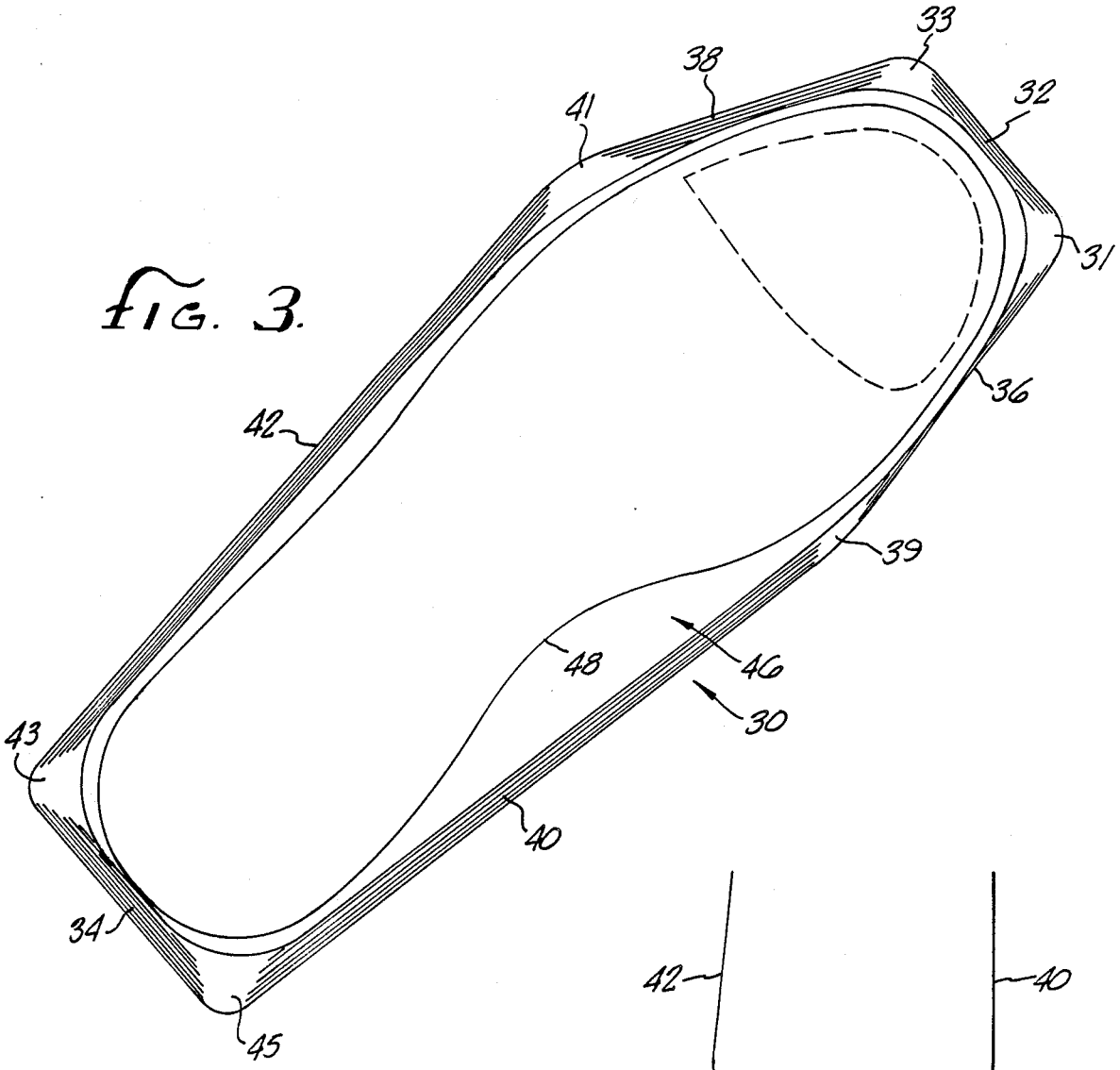
FIG. 3 is a bottom plan view of the sole.
Figure 4A:
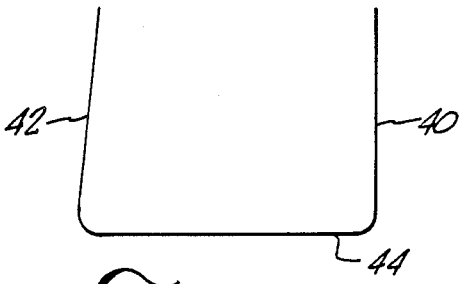
FIG. 4*a*–4*b* are sectional views of the shoe.
Figure 4D:
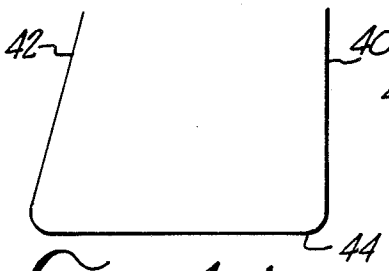
Figure 4C:
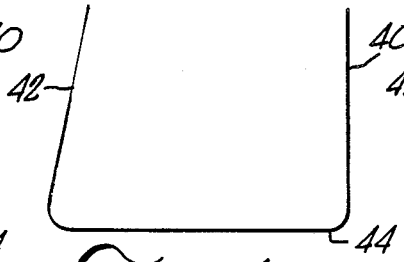
Figure 4B:
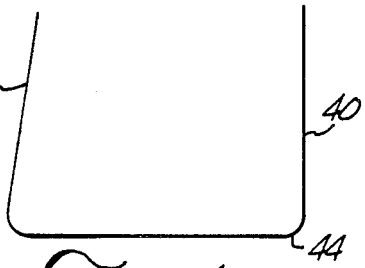

The shoe 2 also includes a sole portion 30 as shown in FIG. 3. The sole includes a toe portion 32, a heel portion 34, a forward instep side portion 36, a forward outer side portion 38, a rearward instep side portion 40 and a rearward outer side portion 42. These sole portions extend upwardly from the bottom surface 44 of the sole to a predetermined height in order to provide dimensionally enhanced, visually defined object control surfaces which are of substantially planar shape. Although FIG. 3 illustrates a shoe having six control surfaces extending from the bottom 44 of the sole 32, it would be possible to provide additional, or fewer, control surfaces as desired.

The rearward instep side 40 of the sole 30 is flat from the heel 34 to the region 39 at the knuckle of the big toe. In this region the sole gently curves approximately 20° to the forward instep side 36. At region 31 another curve (approximately 70°) precedes the toe portion 32. The region 33 leading to the outside of the shoe is curved approximately 60°. The region 41 comprises a curve of approximately 25°. This leads into the rearward outer side 42. The rearward outer side 42 extends from the baby toe at the region 41 to the region 43 where a curve of approximately 83° connects the rearward outer side 42 with the heel portion 34. The final curve from the heel portion 34 to the rearward instep 40 at the region 45 is approximately 87°. Of course, the angles of the various regions can be varied in accordance with design objectives.

The outline of a standard shoe sole is shown as element 46 in FIG. 3. This configuration contains many curved surfaces around the exterior of the sole, especially at the instep where a compound concave curve 48 is found. Ordinarily, the instep 48 would provide an undesirable object control surface. The standard instep portion 48 is not only a complex concave curve at the bottom of the sole, but also curves outwardly as the surface develops upwardly. Thus, the instep is a compound curve in three dimensions. The object control surface 40 of the shoe shown in FIG. 3, on the other hand, is not curved at all, but is substantially planar. Thus, object control is enhanced. The other object control surfaces eliminate undesirable curved surfaces around the remaining portions of the shoe sole.

As shown in FIGS. 1 and 2, the sole portions 22–32 extend upwardly from the bottom of the sole in order to cover a significant portion of the upper 2 and thereby provide dimensionally enhanced object control surfaces. These enhanced surfaces provide an enlarged impact area to increase the percentage of effective kicks. Being substantially planar, the surfaces are also well defined visually so as to enable superior eye - foot coordination and interaction. Beginning from the heel portion 34, the sole 2 extends to the top of the shoe upper 4. The rearward instep portion 40 of the sole follows along the top portion of the instep quarter 12 at an inclining angle. The sole then comes to an apex where the shoe lacing 22 begins, and declines to the top of the big toe knuckle at the region 39. At this point the sole wraps around the toe area similar to standard shoe soles except that the forward surface is, of course, substantially planar. The sole height increases slightly at the region 41 to create a substantially planar upper object control surface. At the region 41, the top of the sole inclines in a straight line to the top of the heel. The sole looks quite a bit thicker than a standard sole on the outside. On the inside, however, the sole is of standard thickness (actual thickness of the bottom of the shoe sole).

Turning to FIGS. 4(*a*)–(*d*), the preferred angles of the side portions of the sole 30 with respect to the bottom 44 thereof are shown. FIG. 4(*b*) depicts an angle of approximately 5° to 15° from vertical, which is preferred over other angles. This angle range provides both increased stability as a running shoe and improved kicking performance for the outside kick of the footbag player. The inclination will not interfere with any soccer kicks.

Thus, an athletic shoe for controlling an object with the foot is disclosed. While embodiments and applications of the invention have been shown and described, it would be apparent to those skilled in the art that many more modifications are possible without departing from the inventive concepts herein. The invention therefore, is not to be restricted except in the spirit of the appended claims.

What is claimed is:

1. An athletic shoe for controlling an object for a game or the like, said shoe comprising a sole having a non-curved instep and a substantially planar object control surface extending from said instep.

2. The athletic shoe set forth in claim 1 further including substantially planar forward, lateral and rearward object control surfaces.

3. The athletic shoe set forth in claim 2 further including a substantially planar upper object control surface.

4. An athletic shoe for controlling an object comprising:

a sole, said sole having in substantially contiguous relation, a substantially planar toe portion, a substantially planar heel portion, substantially planar forward side portions and substantially planar rearward side portions extending between said toe and heel portions;

an upper, said upper having a substantially planar forward upper portion for controlling an object; and substantially planar object control surface extending from said toe, heel and side portions of said sole at a predetermined angle.

5. The athletic shoe set forth in claim 4 wherein the angle between said sole and said side members is less than 90°.

6. An athletic shoe for controlling an object with the foot comprising:

a sole;

a forward object control surface;

a rearward object control surface;

an upper object control surface;

a pair of forward lateral object control surfaces;

a pair of rearward lateral object control surfaces;

said object control surfaces being substantially planar and extending from said sole at an angle of less than 90°.

7. A sole for use with an athletic shoe for controlling an object for a game or the like, said sole comprising a non-curved instep portion and a plurality of object control surfaces extending therefrom at an angle of less than 90 degrees.

* * * * *